United States Patent [19]

Rae

[11] 4,231,569

[45] Nov. 4, 1980

[54] EXERCISING DEVICE

[76] Inventor: Scott M. Rae, 317 Adahi Rd., S. E., Vienna, Va. 22180

[21] Appl. No.: 911,903

[22] Filed: Jun. 2, 1978

[51] Int. Cl.[3] ..... A63B 11/04

[52] U.S. Cl. ..... 272/122; 272/67; 272/117

[58] Field of Search ..... 272/117, 118, 119, 122, 272/123, 67, 116, 124

[56] References Cited

U.S. PATENT DOCUMENTS

| | | | |
|---|---|---|---|
| 460,270 | 9/1891 | Somerby | 272/122 |
| 734,062 | 7/1903 | Harris | 272/122 |
| 1,333,005 | 3/1920 | Warner | 272/123 |
| 1,917,566 | 7/1933 | Wood | 272/122 |
| 2,263,135 | 11/1941 | Johnson | 272/122 X |
| 2,617,650 | 11/1952 | Landis | 272/122 |
| 3,120,954 | 2/1964 | Apostol | 272/117 |
| 3,998,454 | 12/1976 | Jones | 272/117 |
| 4,039,183 | 8/1977 | Sakurada | 272/67 |
| 4,109,908 | 8/1978 | Pugh et al. | 272/119 |

*Primary Examiner*—Richard J. Apley

*Attorney, Agent, or Firm*—Birch, Stewart, Kolasch & Birch

[57] ABSTRACT

An exercising device which comprises a frame member having two end portions and an intermediate portion disposed therebetween, one of said end portions adapted to receive a weight member, and a handle means rotatably attached to the other of said end portions, said intermediate portion of said frame member being shaped to contain an arm-engaging surface adjacent said handle means.

12 Claims, 9 Drawing Figures

EXERCISING DEVICE

BACKGROUND AND SUMMARY OF THE INVENTION

The present invention relates to an exercising device which is utilized for performing body-building and general exercising procedures. More particularly, the present invention is directed to an arm exercising device which makes maximum use of the arm muscles in performing a variety of muscle-building and exercising procedures.

Because of the recent emphasis and importance which is being placed upon achieving good health and physical fitness, more attention is being given to various ways of providing exercise for the human body.

Many weight training exercises consist of raising and lowering a barbell or dumbbell along a curved path about some axis. The axis itself passes through some joint of the body such as the elbow or the shoulder. A deficiency of some of these exercises exists in that when the weight is nearly directly above of nearly directly below the axis, very little torque is being exerted about said axis, and accordingly, at these particular positions, the muscles are exerting very little effort even though the primary muscles being exercised may still be capable of exerting a strong force at these points.

An example of the type of exercise referred to above is the standing biceps curl for the biceps brachii, that is, the flexor muscle on the front of the upper arm. At the beginning of the exercise, the weight is almost directly below the elbow and at the end of or at the top of the exercise the weight is almost directly above the elbow, so that at these particular portions of the exercise, the arm bone is utilized to support the weight and not the force of the biceps muscle. Obviously, during the middle of the arm exercise, that is, the movement between the lowermost and uppermost point in the exercise, the arm muscles do come into play.

Various cam machines have been developed which maintain a relatively large resistance throughout various arm exercises and arm movements. However, such devices are relatively large and, of course, very expensive.

Accordingly, an object of the present invention is to provide an improved exercising device which enables the exerciser to perform various exercises, particularly arm exercises which expose the arm muscles to a considerable amount of muscle-exercising strain during substantially all of the movements of the exercising procedure.

Another object of the present invention is to provide an improved exercising device for conducting various arm exercises which ensures that there is a strong torque or moment of force about the elbow and hence, a heavy load on the biceps during substantially all portions of the exercising movement.

A further object of the present invention is to provide an improved arm-exercising device which maintains a relatively large resistance to movement of a weight, for example, a dumbbell, through various types of arm exercises, for example, a biceps bench curl.

Other objects and further scope of applicability of the present invention will become apparent from the detailed description given hereinafter; it should be understood, however, that the detailed description and accompanying drawings, while indicating preferred embodiments of the present invention, are given by way of illustration only, since various changes and modifications within the spirit and scope of the invention will become apparent to those skilled in the art from this detailed description.

Pursuant to the present invention, the above-mentioned disadvantages can be eliminated by providing an exercising device wherein the weight to be lifted is so positioned, relative to the hand grip so that a maximum torque or moment of force is exerted about the elbow so that the biceps and other ancillary muscles in the arm must continue to exert a strong force to support the weight during substantially all portions of the arm-exercising procedure. In the device of the present invention, the handle of the device is rotatably disposed within a frame member and the weight to be lifted is also disposed in the frame member at a predetermined distance from the handle. Thus, as the weight is lifted by the arm from a fully extended lower position of the arm to a fully raised position where the arm is bent at the elbow, such as in the case of performing a bench curl exercise with a dumbbell, the weight, which is disposed in the frame member travels along two distinct arcs without touching the user, whereas the handle travels along but one arc. Thus, at the uppermost position of the arm exercise, the weight still exerts a moment about the elbow which is equal to the weight of the dumbbell times the distance the dumbbell is disposed in the frame member from the handle, so that the biceps must continue to exert a strong force to support the weight. This is to be compared with the ordinary bench curl exercise which is performed with a dumbbell wherein at the top of the exercising movement the dumbbell is disposed almost directly above the elbow where no moment is exerted about the elbow. In this instance, the weight of the dumbbell is only supported by the bone and not by the muscle. Furthermore, in performing the ordinary bench curl, as the weight is lifted from a lower position with the arm extended to the upper position where the arm is bent at the elbow, the moment which is created about the elbow is continually reduced as the weight is lifted from a lower to an upper position since during the bench curl exercise, the position of the weight gradually approaches a position above the elbow during the exercise which, of course, reduces the moment about the elbow. In the device of the present invention, because the weight is disposed in the frame member at a predetermined position from the handle, a maximum moment is always produced about the elbow during the performance of a bench curl exercise. One of the advantageous features of maintaining a continuous load on the biceps at all times during the arm exercise is that it tires the muscle much faster. This is important because ancillary muscles, such as those in the forearm, are also being used and developed.

As mentioned above, the prior art devices generally comprise a very complicated cam machine which is utilized for performing biceps curls. This machine is very complicated and makes use of counterweights, pulleys, an extensive framing apparatus, and other complicating features. Other prior art devices are shown in U.S. Pat. Nos. 734,062 and 2,617,650. In U.S. Pat. No. 734,062, the device disclosed therein is merely concerned with varying the distance between a weight and a handle means. U.S. Pat. No. 2,617,650 shows an adjustably weighted dumbbell device wherein by positioning the weights between the hand and the shoulder of the user, the weights are handled with a shorter leverage from the shoulder than if they were held in the hand, and thus a greater amount of weight can be handled with the device shown therein. It is readily apparent that none of the devices shown in the respective U.S. patents even remotely suggest the device of the present invention as discussed hereinabove.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

Figure 1:
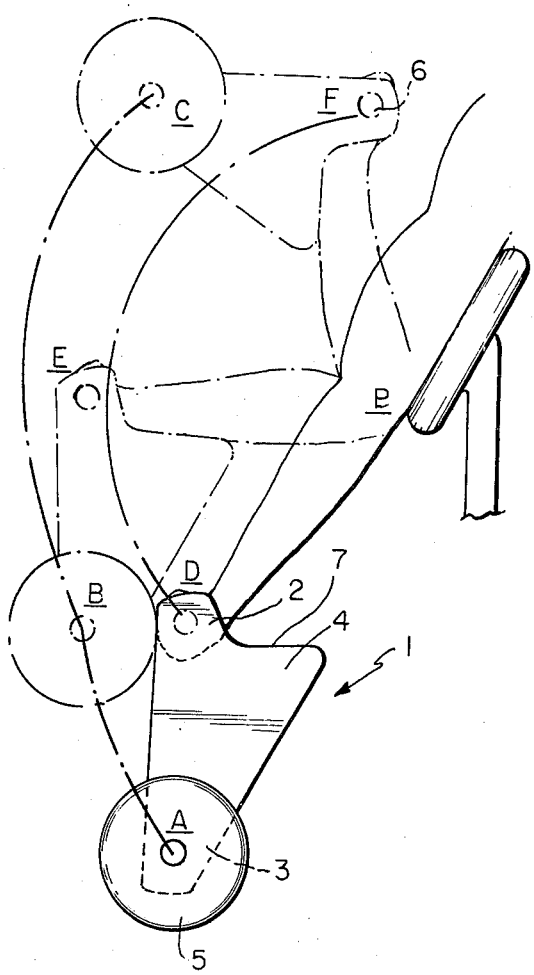
FIG. 1 shows an arm exercising procedure utilizing the device of the present invention.
Figure 2A:
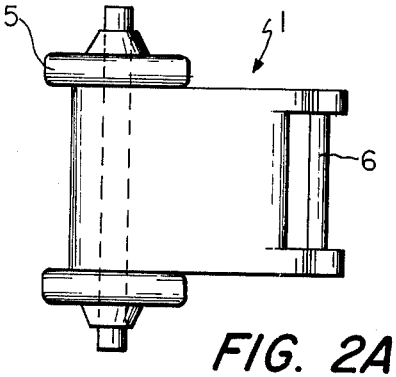
FIGS. 2A, 2B and 2C show various uses of the device utilized in FIG. 1.
Figure 2B:
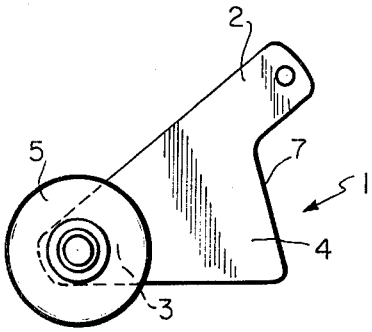
Figure 2C:
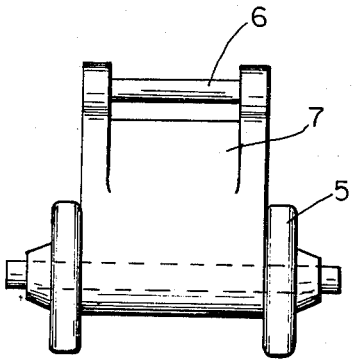

The exercising device of the present invention comprises a frame member 1 having two end portions 2 and 3 and an intermediate portion 4 disposed therebetween. One of said end portions 3 is adapted to receive a weight member 5 and the other end portion 2 is adapted to receive a handle 6 which is rotatably disposed therein. The intermediate portion 4 is shaped so as to contain an arm-engaging surface 7 which is disposed substantially adjacent to the handle 6. Generally speaking, the handle and the arm-engaging surface are disposed in substantially the same plane, with said plane being disposed a predetermined distance from the weight member 5. However, it is apparent that the handle and arm-engaging surface can be disposed in different planes.

FIG. 1 shows an ordinary bench curl exercise utilizing the device of the present invention. As can be seen by referring to FIG. 1, the weight travels along two distinct arcs without touching the user, that is, arc A B and arc B C, whereas the handle travels along but one arc defined by D E F. The arc D E F represents the same arc which would be followed when the user is performing an ordinary bench curl exercise utilizing a dumbbell. In this situation, the dumbbell composed of a weight and a handle is held by the user's hand and follows the arc D E F as the dumbbell is raised from a lower position to an upper position. At the top of the bench curl exercise, the dumbbell is almost directly above the elbow or pivot point P so that at this position, no moment is exerted about pivot point P. This means that at this point in the exercise the weight is being supported by the bone and not by the biceps muscle. However, when utilizing the device of the present invention, wherein the weight is disposed at a predetermined distance from the handle, at the top of an ordinary bench curl exercise, the dumbbell or weight still exerts a significant moment about the elbow or pivot point P so that the biceps must continue to exert a strong force to support the weight. As is well known, the moment is equal to the weight of the dumbbell times the horizontal component of the distance between the weight and the pivot point P. It should also be noted that the height that the weight has to be raised is greater when utilizing the device of the present invention than the height when performing a bench curl utilizing an ordinary dumbbell.

Figure 3:
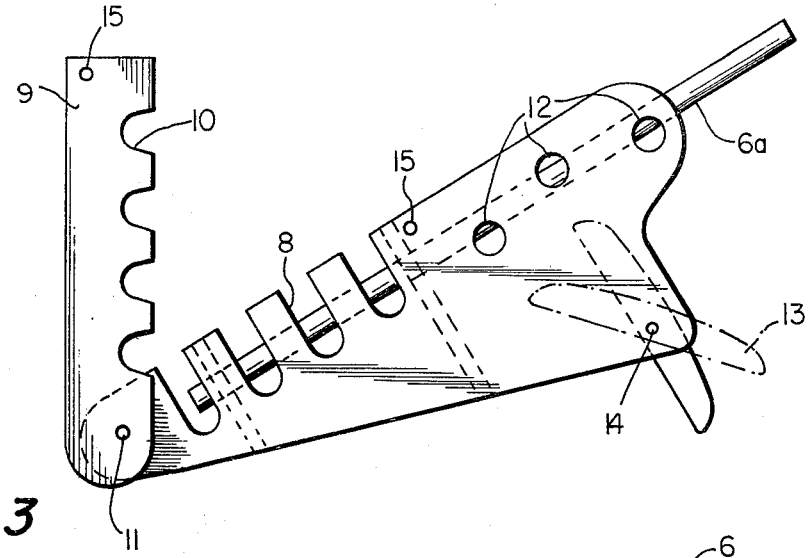
FIG. 3 shows another embodiment of the present invention wherein means are provided for varying the position of both the weight and the handle in the frame member of the device.

FIG. 3 shows another embodiment of the exercising device of the present invention wherein the position of the weight as well as the position of the handle can be varied within the frame member. As shown in this embodiment, the frame member is provided with a plurality of slots 8 which are adapted to receive the handle portion of a dumbbell. A locking member 9 containing a plurality of slots 10 is pivotably attached to the frame member by pivot member 11, said locking member being adapted to close on the slots 8, thereby holding the handle of the barbell in position within the frame member. The frame member also contains a plurality of holes 12 for varying the location of the handle means in the frame member. In this embodiment the arm-engaging surface is a support member 13 which can be cushioned and which is adapted to rotate about pivot point 14 in accordance with the position which is selected for the handle. The locking member and the frame member are also provided with holes 15 through which a locking pin can pass for holding the locking member in a fixed position with the frame member. Handle means 6*a* shows an alternative disposition of handle means within the frame of the exercising device.

Figure 4:
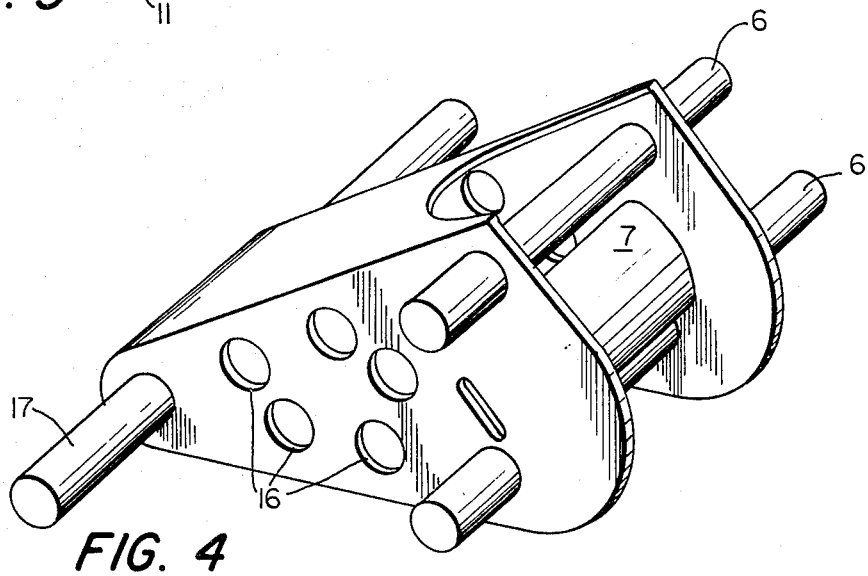
FIG. 4 shows another embodiment of the device of the present invention where multiple handles can be utilized.

FIG. 4 shows still another embodiment of the present invention wherein a plurality of holes 16 are provided in the frame member for varying the location of the bar 17 to which the weights are attached. FIG. 4 also shows the use of handles 6 disposed on both sides of the arm-engaging surface 7.

Figure 5:
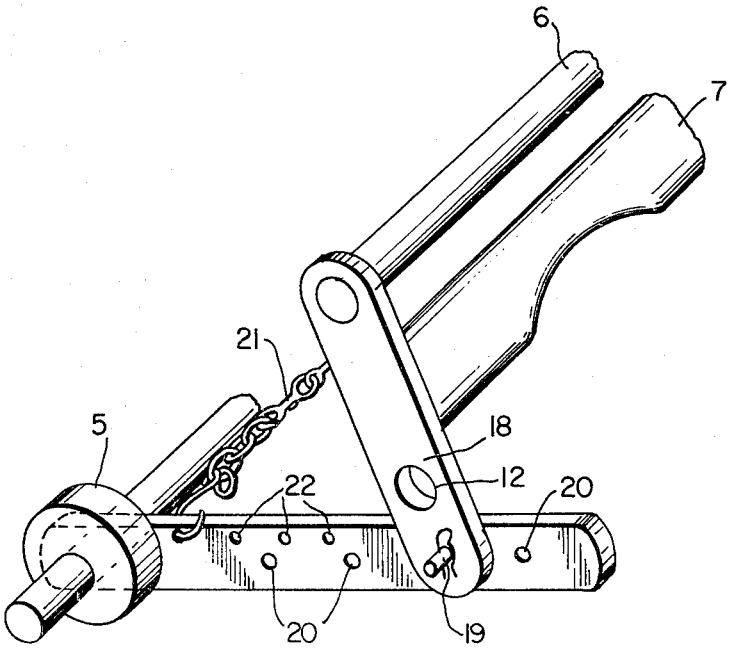
FIG. 5 shows still another embodiment of the present invention where the length of the lever arm between the handle and the weight can be varied by varying the angle formed between the position of the handle and the position of the weight.

FIG. 5 shows a first frame member which contains the barbell weight and a second frame member 18 containing handle means 6 and arm-supporting member 7. The second frame member is rotatably secured to the first frame member by pin 19. As can be readily seen, the position of the second frame member, relative to the weight 5 can be changed by securing said second member to the first member through one of the plurality of holes 20. Similarly, either the length of the chain 21 can be varied or the position of the chain along the first frame member can be varied by utilizing holes 22. Thus, the distance between the weight member 5 and the second frame member can be varied accordingly. Hole 12 is provided for locating the handle 6 on the opposite side of the arm-supporting member 7, if desired.

Figure 6:
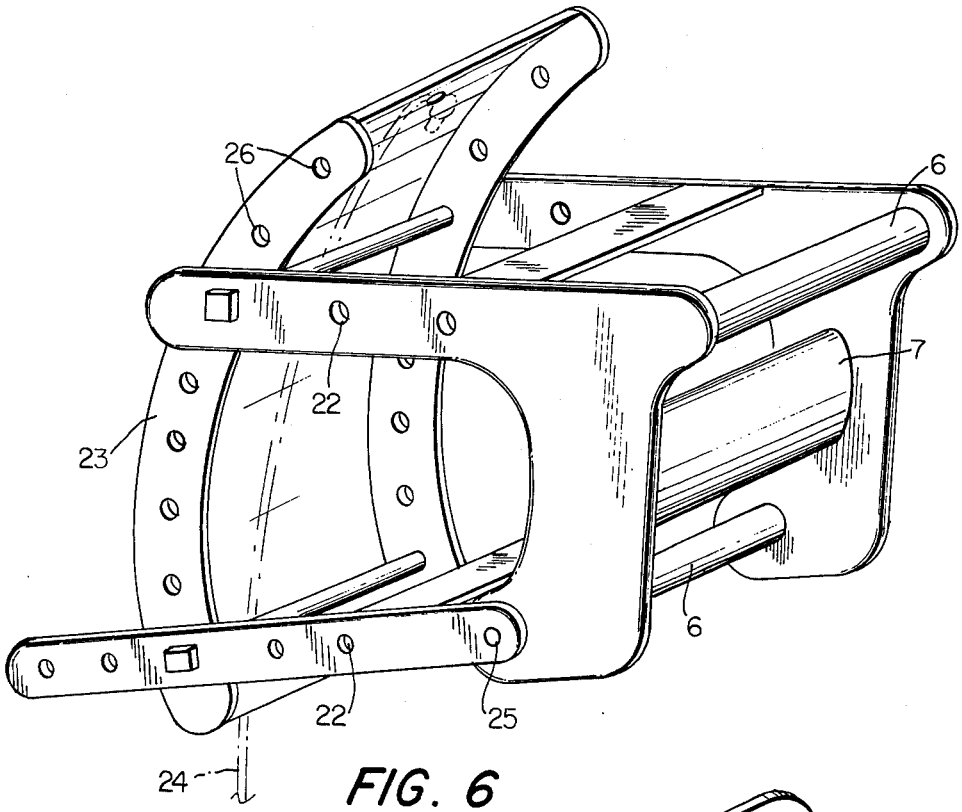
FIGS. 6 and 7 show still further embodiments of the present invention utilizing various combinations of the features shown in FIGS. 1 through 5.

In FIG. 6, a cam plate 23 is advantageously attached to first and second frame members, said cam plate being provided with a cable 24 for attachment to a desired weight. The first and second frame members are pivotably connected together around pivot member 25. The first and second frame members are provided with a plurality of holes 22 for varying the location of the cam plate with respect to the handles 6. For this purpose, the cam plate is also provided with a plurality of holes 26.

Figure 7:
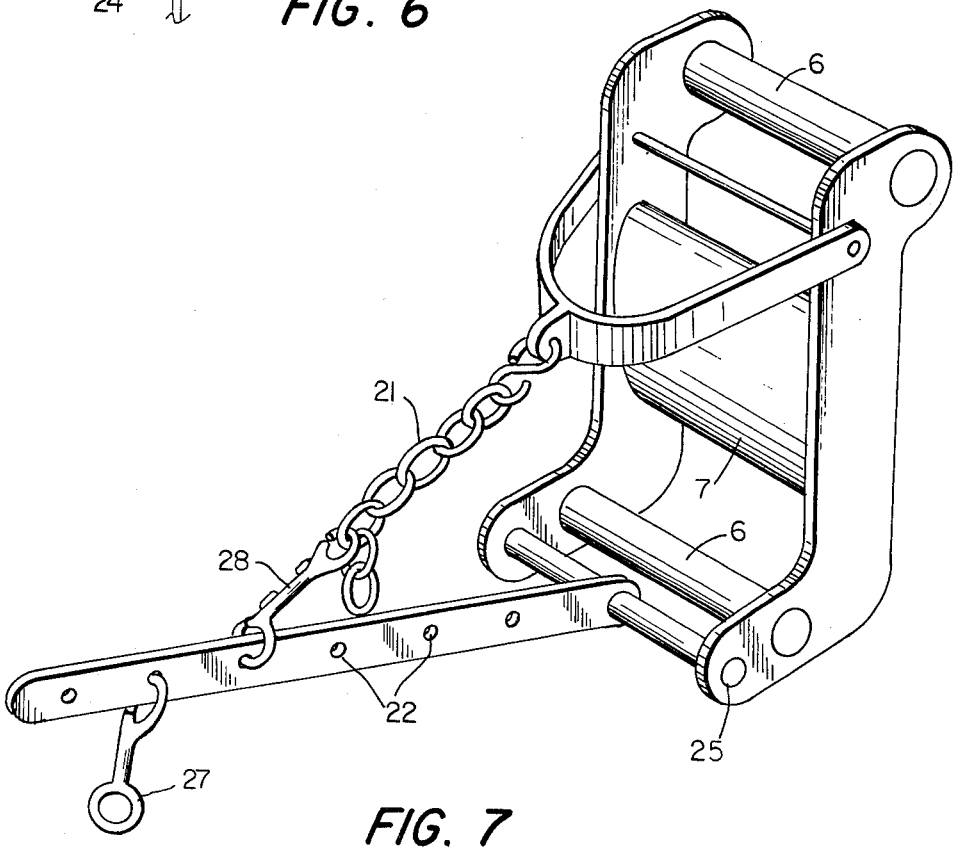

The embodiment of FIG. 7 is similar to that of FIG. 5, with the exception that a catch 27 is utilized for attaching the weight to the first frame member. Another catch member 28 is utilized for varying the location of the chain 21 along the first frame member and for varying the length of the chain 21.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exercising device which comprises an elongated frame member having a longitudinal axis and having two end portions and an intermediate portion disposed therebetween, one of said portions including means for receiving a weight member, and a handle means rotatably attached to the other of said end portions, for rotation about an axis transverse to said longitudinal frame axis, said intermediate portion of said frame member including means shaped to contain an arm-engaging surface adjacent said handle means.

2. The exercising device of claim 1, wherein the arm-engaging surface means is a cushioned surface.

3. The exercising device of claim 1, wherein the frame member has generally a triangular shape with the weight member receiving means being disposed at the apex portion of the triangle and the handle and arm-engaging means being disposed on opposite sides of the base portion of the triangle.

4. The exercising device of claim 1, wherein said weight receiving means includes a plurality of weight position means located in the frame member for varying the position of the weight member relative to the handle means.

5. The exercising device of claim 1, wherein a plurality of handle position means are provided in the frame member for varying the position of the handle means relative to the weight member receiving means.

6. The exercising device of claim 4, wherein the arm-engaging surface means is pivotally disposed within the frame member.

7. The exercising device of claim 5, wherein the arm-engaging surface means is pivotally disposed within the frame member.

8. The exercising device of claim 4, wherein the weight position means are a plurality of slots which are adapted to selectively receive the weight member.

9. The exercising device of claim 4, wherein the weight position means are a plurality of holes which are adapted to selectively receive the weight member.

10. The exercising device of claim 8, wherein a locking member is pivotally attached to the frame member, said locking member being adapted to close on said plurality of slots.

11. The exercising device of claim 5, wherein the handle position means are a plurality of holes which are adapted to selectively receive the handle means.

12. The exercising device of claim 1, wherein the handle means are disposed on both sides of the arm-engaging surface means.

* * * * *